US005686215A

United States Patent [19]

Bergfjord, Sr. et al.

[11] Patent Number: 5,686,215

[45] Date of Patent: Nov. 11, 1997

[54] MULTILAYERED ELECTROPHOTOGRAPHIC IMAGING MEMBER

[75] Inventors: John A. Bergfjord, Sr., Macedon; Joseph S. Cappiello, Rochester; Kathleen M. Carmichael, Williamson; Vincent J. Cilento, Rochester; Colleen A. Helbig, Webster; Neil S. Patterson, Pittsford; Michael S. Roetker, Rochester; Joellen Simone, Ontario, all of N.Y.

[73] Assignee: Xerox Corporation, Stamford, Conn.

[21] Appl. No.: 782,161

[22] Filed: Jan. 13, 1997

[51] Int. Cl.[6] ..... G03G 5/047

[52] U.S. Cl. ..... 430/58; 430/63; 430/64

[58] Field of Search ..... 430/58, 59, 63, 430/64

[56] References Cited

U.S. PATENT DOCUMENTS

| | | | |
|---|---|---|---|
| 4,265,990 | 5/1981 | Stolka et al. | 430/59 |
| 4,464,450 | 8/1984 | Teuscher | 430/59 |
| 4,588,667 | 5/1986 | Jones et al. | 430/73 |
| 4,780,385 | 10/1988 | Wieloch et al. | 430/58 |
| 4,786,570 | 11/1988 | Yu et al. | 430/58 |
| 5,384,222 | 1/1995 | Normandin et al. | 430/58 |
| 5,384,223 | 1/1995 | Listigovers et al. | 430/59 |
| 5,492,785 | 2/1996 | Normandin et al. | 430/58 |
| 5,571,649 | 11/1996 | Miskra et al. | 430/59 |

*Primary Examiner*—John Goodrow

[57] ABSTRACT

An electrophotographic imaging member including an electrophotographic imaging member having an imaging surface adapted to accept a negative electrical charge, the electrophotographic imaging member including a substrate, a siloxane hole blocking layer, an adhesive layer including a uniform blend of polyarylate film forming resin and a polyester film forming resin, a charge generation layer including hydroxygallium phthalocyanine particles dispersed in a film forming resin, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

15 Claims, No Drawings

MULTILAYERED ELECTROPHOTOGRAPHIC IMAGING MEMBER

BACKGROUND OF THE INVENTION

This invention relates in general to electrophotography and more specifically, to an improved electrophotographic imaging member.

In the art of electrophotography an electrophotographic plate comprising a photoconductive insulating layer on a conductive layer is imaged by first uniformly electrostatically charging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

As more advanced, higher speed electrophotographic copiers, duplicators and printers were developed, degradation of image quality was encountered during extended cycling. Moreover, complex, highly sophisticated, duplicating and printing systems operating at very high speeds have placed stringent requirements including narrow operating limits on photoreceptors. For example, the layers of many modern photoconductive imaging members must be highly flexible, adhere well to each other, and exhibit predictable electrical characteristics within narrow operating limits to provide excellent toner images over many thousands of cycles.

One type of popular belt type photoreceptors comprises a vacuum deposited metal coated with two electrically operative layers, including a charge generating layer and a charge transport layer. The metal layer or ground plane is typically aluminum, titanium, zirconium and the like coated on a polyester film. The coating is sputtered on the polyester film in a layer about 175 angstroms thick. The metal layer acts as a conductive path for electrons during the exposure step in the photoconductive process. Photoreceptors containing metal ground planes are described, for example, in U.S. Pat. No. 4,588,667 and U.S. Pat. No. 4,780,385, the entire disclosures of these patents are incorporated herein by reference. Although excellent toner images may be obtained with multilayered photoreceptors having a metal ground plane, it has been found that utilization of the metal layer with various charge blocking layers, adhesive layers, charge generating layers and charge transport layers can improve imaging performance. For example, the charge blocking layer may comprise polyvinylbutyral; organosilanes; epoxy resins; polyesters; polyamides; polyurethanes; pyroxyline vinylidene chloride resin; silicone resins; fluorocarbon resins and the like containing an organo metallic salt; and nitrogen containing siloxanes or nitrogen containing titanium compounds such as trimethoxysilyl propylene diamine, hydrolyzed trimethoxysilyl propyl ethylene diamine, N-beta(aminoethyl) gamma-amino-propyl trimethoxy silane, isopropyl 4-aminobenzene sulfonyl, di(dodecylbenzene sulfonyl) titanate, isopropyl di(4-aminobenzoyl) isostearoyl titanate, isopropyl tri(N-ethylaminoethylamino) titanate, isopropyl trianthranil titanate, isopropyl tri(N,N-dimethyl-ethylamino) titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl dimethoxysilane, as disclosed in U.S. Pat. No. 4,291,110, U.S. Pat. No. 4,338,387, U.S. Pat. No. 4,286,033 and U.S. Pat. No. 4,291,110. A preferred blocking layer disclosed in U.S. Pat. No. 4,780,385 comprises a reaction product between a hydrolyzed silane and a metal oxide layer which inherently forms on the surface of most metal layers when exposed to air after deposition.

In some cases, an intermediate layer between the blocking layer and the adjacent generator layer may be used in the photoreceptor of U.S. Pat. No. 4,780,385 to improve adhesion or to act as an electrical barrier layer. Typical adhesive layers disclosed in U.S. Pat. No. 4,780,385 include film-forming polymers such as polyester, polyvinylbutyral, polyvinylpyrolidone, polyurethane, polycarbonates polymethylmethacrylate, mixtures thereof, and the like.

The photogenerating layer utilized in the photoreceptor disclosed in U.S. Pat. No. 4,780,385 include, for example, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal free phthalocyanine, metal phthatocyanines such as vanadyl phthalocyanine and copper phthalocyanine, quinacidones available from DuPont under the tradename Mortastral Red, Monastral violet and Monastral Red Y, Vat orange 1 and Vat Orange 3 trade names for dibromo anthanthrone pigments, benzimidazole perylene, substituted 2,4-diamino-triazines, polynuclear aromatic quinones available from Allied Chemical Corporation under the tradename indofast Double Scarlet, Indofast Violet Lake B, Indofast Brilliant Scarlet and Indofast Orange, and the like dispersed in a film forming polymeric binder. Selenium, selenium alloy, benzimidazole perylene, and the like and mixtures thereof may be formed as a continuous, homogeneous photogenerating layer. Other suitable photogenerating materials known in the art may also be utilized, if desired. Charge generating binder layer comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred for the photoreceptor of U.S. Pat. No. 4,780,385 because of their sensitivity to white light.

Although excellent images may be obtained with the photoreceptor described in U.S. Pat. No. 4,780,385, it has also been found that for certain specific combinations of materials in the different layers, adhesion of the various layers under certain manufacturing conditions can fail and result in delamination of the layers during or after fabrication. Photoreceptor life can be shortened if the photoreceptor is extensively image cycled over small diameter rollers. Also, during extensive cycling, many belts exhibit undesirable dark decay and cycle down characteristics. The expression "dark decay" is defined as the loss of applied voltage from the photoreceptor in the absence of light exposure. "Cycle down", as utilized here and as defined as the increase in dark decay with increased charge/erase cycles of the photoreceptor.

A typical multi-layered photoreceptor exhibiting dark decay and cycle down under extensive cycling utilizes a charge generating layer containing trigonal selenium particles dispersed in a film-forming binder. It has also been found that multi-layered photoreceptors containing charge generating layers utilizing trigonal selenium particles are relatively insensitive to visible laser diode exposure systems.

Multi-layered photoreceptors containing charge generating layers comprising hydroxygallium phthalocyanine pigments have been found to exhibit excellent spectral sensitivity. However, some multi-layered photoreceptors containing hydroxygallium phthalocyanine pigments in the charge generating layer have been found delaminate during extended image cycling.

Typically, flexible belts are fabricated by depositing the various layers of the photoreceptor as coatings onto long belts which are thereafter cut into sheets. The opposite ends of these sheets are welded together to form the belt. In order to increase throughput during the web coating operation, the webs to be coated have a width of twice the width of a final belt. After coating, the web is slit lengthwise and thereafter transversely to form each sheet that is eventually welded into a belt. When multi-layered photoreceptors containing hydroxygallium phthalocyanine in the charge generating layer are slit lengthwise during the belt fabrication process, it has been found that some of the photoreceptor delaminates and becomes unusable. Delamination also prevents grinding of belt web seam to control seam thickness. All of these deficiencies hinder slitting of a web through the charge generating layer without encountering edge delamination or coating double wide charge generating layers to allow slitting into multiple narrower charge generating layers without encountering crossweb defects.

In general, photoconductive pigment loadings of 80 percent by volume are highly desirable in the photogenerating layer to provide excellent photosensitivity. These loadings, particularly when utilizing hydroxygallium phthalocyanine pigment to form generator layers with poor to adequate adhesion to the underlying ground plane layer, blocking layer or adhesive layer. Adhesion can be improved or worsened by using various adhesive materials in an adhesive layer between the charge generating layer and the ground plane layer or blocking layer. Poor adhesion between the generator layer and the adhesive or other underlying surface can lead to photoreceptor delamination when subjected to slitting operations during belt fabrication or during extensive cycling of the final belt over small diameter rollers. Moreover, the use of some materials for the adhesive layer can negatively impact the electrical properties of a photoreceptor.

In addition, when a multilayered belt imaging member containing hydroxygallium phthalocyanine pigment dispersed a film forming binder in the charge generating layer is fabricated by welding opposite ends of a web together, delamination is encountered when attempts are made to grind away some of the weld splash material. Removal of the weld splash material allows the elimination of seams which form flaps that initially trap toner particles and thereafter release them as unwanted dirt. Also, the inability to grind, buff, or polish a welded seam causes reduced cleaning blade life and renders the seam incompatible with ultrasonic transfer subsystems.

Thus, there is a continuing need for improved hydroxygallium phthalocyanine photoreceptors that exhibit improved electrical properties and which are more resistant to delamination during slitting, grinding, buffing, polishing and image cycling.

INFORMATION DISCLOSURE STATEMENT

U.S. Pat. No. 5,492,785 to S. Normandin et al., issued Feb. 20, 1996—An electrophotographic imaging member is disclosed having an imaging surface adapted to accept a negative electrical charge, the electrophotographic imaging member comprising a metal ground plane layer comprising at least 50 percent by weight of zirconium, a siloxane hole blocking layer, an adhesive layer comprising a polyarylate film forming resin, a charge generation layer comprising benzimidazole perylene particles dispersed in a film forming resin binder of poly(4,4'-diphenyl-1,1'-cyclohexane carbonate), and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

U.S. Pat. No. 4,786,570 to Yu et al., issued Nov. 22, 1988—A flexible electrophotographic imaging member is disclosed which comprises a flexible substrate having an electrically conductive surface, a hole blocking layer comprising an aminosilane reaction product, an adhesive layer having a thickness between about 200 angstroms and about 900 angstroms consisting essentially of at least one copolyester resin having a specified formula derived from diacids selected from the group consisting of terephthalic acid, isophthalic acid, and mixtures thereof and a diol comprising ethylene glycol, the mole ratio of diacid to diol being 1:1, the number of repeating units equaling a number between about 175 and about 350 and having a Tg of between about 50° C. to about 80° C., the aminosilane also being a reaction product of the amino group of the silane with the —COOH and —OH end groups of the copolyester resin, a charge generation layer comprising a film forming polymeric component, and a diamine hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer. Processes for fabricating and using the flexible electrophotographic imaging member are also disclosed. U.S. Pat. No. 4,780,385 to Wieloch et al., issued Oct. 25, 1988—An electrophotographic imaging member is disclosed U.S. Pat. No. 5,571,649 to A. Mishra et al., issued Nov. 5, 1996—An electrophotographic imaging member is disclosed comprising a support substrate having a two layered electrically conductive ground plane layer comprising a layer comprising zirconium over a layer comprising titanium, a hole blocking layer, an adhesive layer comprising a polymer blend comprising a carbazole polymer and a thermoplastic resin selected from the group consisting of copolyester, polyarylate and polyurethane in contiguous contact with the hole blocking layer, a charge generation layer comprising perylene or a phthalocyanine pigment particles dispersed in a polycarbonate film forming binder in contiguous contact with the adhesive layer, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer. This photoreceptor is utilized in an electrophotographic imaging process.

U.S. Pat. No. 5,384,222 to S. Normandin et al., issued Jan. 24, 1995—A process is disclosed for the preparation of a photogenerating composition which comprises mixing titanyl phthalocyanine Type IV with the AB block copolymer polystyrene-4-vinyl pyridine.

U.S. Pat. No. 5,384,223 to N. Listigovers et al., issued Jan. 24, 1995—A photoconductive imaging member is disclosed comprised of a supporting substrate, a photogenerating layer comprised of photogenerating pigments dispersed in a polystyrene/polyvinyl pyridine ($A_n$-$B_m$) block copolymer wherein n represents the degree of polymerization of A and m represents the degree of polymerization of B monomer, and a charge transport layer.

U.S. Pat. No. 4,780,385 to Wieloch et al., issued Oct. 25, 1988—An electrophotographic imaging member is disclosed having an imaging surface adapted to accept a negative electrical charge, the electrophotographic imaging member comprising a metal ground plane layer comprising zirconium, a hole blocking layer, a charge generation layer comprising photoconductive particles dispersed in a film forming resin binder, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

U.S. Pat. No. 4,588,667 to Jones et al., issued May 13, 1986—An electrophotographic imaging member is disclosed comprising a substrate, a ground plane layer comprising a titanium metal layer contiguous to the substrate, a charge blocking layer contiguous to the titanium layer, a charge generating binder layer and a charge transport layer. This photoreceptor may be prepared by providing a substrate in a vacuum zone, sputtering a layer of titanium metal on the substrate in the absence of oxygen to deposit a titanium metal layer, applying a charge blocking layer, applying a charge generating binder layer and applying a charge transport layer. If desired, an adhesive layer may be interposed between the charge blocking layer and the photoconductive insulating layer.

U.S. Pat. No. 4,464,450 to Teuscher, issued Aug. 7, 1984—An electrostatographic imaging member is disclosed having two electrically operative layers including a charge transport layer and a charge generating layer, the electrically operative layers overlying a siloxane film coated on a metal oxide layer of a metal conductive anode, said siloxane film comprising a reaction product of a hydrolyzed silane having a specified general formula.

U.S. Pat. No. 4,265,990 to Stolka et al., issued May 5, 1981—A photosensitive member is disclosed having at least two electrically operative layers is disclosed. The first layer comprises a photoconductive layer which is capable of photogenerating holes and injecting photogenerated holes into a contiguous charge transport layer. The charge transport layer comprises a polycarbonate resin containing from about 25 to about 75 percent by weight of one or more of a compound having a specified general formula. This structure may be imaged in the conventional xerographic mode which usually includes charging, exposure to light and development.

SUMMARY OF THE INVENTION

It is, therefore, an object of the present invention to provide an improved photoreceptor member which overcomes the above-noted disadvantages.

It is a further object of the present invention to provide a photoconductive imaging member which enables successful slitting a wide web lengthwise through a charge generation layer hydroxygallium phthalocyanine It is still another object of the present invention to provide an electrophotographic imaging member having welded seams that can be buffed or ground without delaminating.

It is another object of the present invention to provide an electrophotographic imaging member which exhibits lower dark decay and improved cyclic stability, as well as having photoresponse to the visible laser diode.

The foregoing objects and others are accomplished in accordance with this invention by providing an electrophotographic imaging member comprising an electrophotographic imaging member having an imaging surface adapted to accept a negative electrical charge, the electrophotographic imaging member comprising a substrate, a siloxane hole blocking layer, an adhesive layer comprising a uniform blend of polyarylate film forming resin and a polyester film forming resin, a charge generation layer comprising hydroxygallium phthalocyanine particles dispersed in a film forming resin, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

The substrate may be opaque or substantially transparent and may comprise numerous suitable materials having the required mechanical properties. Accordingly, this substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like. Preferably, the substrate is in the form of an endless flexible belt and comprises a commercially available biaxially oriented polyester known as Mylar, available from E. I. du Pont de Nemours & Co. or Melinex available from ICI.

The thickness of the substrate layer depends on numerous factors, including economical considerations, and thus this layer for a flexible belt may be of substantial thickness, for example, over 200 micrometers, or of minimum thickness less than 50 micrometers, provided there are no adverse affects on the final photoconductive device. In one flexible belt embodiment, the thickness of this layer ranges from about 65 micrometers to about 150 micrometers, and preferably from about 75 micrometers to about 125 micrometers for optimum flexibility and minimum stretch when cycled around small diameter rollers, e.g. 12 millimeter diameter rollers.

If the substrate is coated with a conductive layer, the conductive layer may vary in thickness over substantially wide ranges depending on the optical transparency and degree of flexibility desired for the electrostatographic member. Accordingly, for a flexible electrophotographic imaging device, the thickness of the conductive layer may be between about 20 angstroms to about 750 angstroms, and more preferably from about 100 angstroms to about 200 angstroms for an optimum combination of electrical conductivity, flexibility and light transmission. The flexible conductive layer may be an electrically conductive metal layer formed, for example, on the substrate by any suitable coating technique, such as a vacuum depositing technique.

Typical metals include aluminum, copper, gold, zirconium, titanium, niobium, tantalum, vanadium and hafnium, titanium, nickel, stainless steel, chromium, tungsten, molybdenum, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

Preferably, the metal layer comprises zirconium and/or titanium. The zirconium and/or titanium layer may be formed by any suitable coating technique, such as vacuum depositing technique. Typical vacuum depositing techniques include sputtering, magnetron sputtering, RF sputtering, and the like. Magnetron sputtering of zirconium or titanium onto a metallized substrate can be effected by a conventional type sputtering module under vacuum conditions in an inert atmosphere such as argon, neon, or nitrogen using a high purity zirconium or titanium target. The vacuum conditions are not particularly critical. In general, a continuous zirconium or titanium film can be attained on a suitable substrate, e.g. a polyester web substrate such as Mylar available from E.I. du Pont de Nemours & Co. with magnetron sputtering. It should be understood that vacuum deposition conditions may all be varied in order to obtain the desired zirconium or titanium thickness. Typical techniques for forming the zirconium and titanium layers are described in U.S. Pat. Nos. 4,780,385 and 4,588,667, the entire disclosures of which are incorporated herein in their entirety.

The conductive layer may comprise a plurality of metal layers with the outermost metal layer (i.e. the layer closest to the charge blocking layer) comprising at least 50 percent by weight of zirconium, titanium or mixtures thereof. At least 70 percent by weight of zirconium and/or titanium is preferred in the outermost metal layer for even better results. The multiple layers may, for example, all be vacuum deposited or a thin layer can be vacuum deposited over a thick layer prepared by a different techniques such as by casting. Thus, as an illustration, a zirconium metal layer may be formed in a separate apparatus than that used for previously depositing a titanium metal layer or multiple layers can be deposited in the same apparatus with suitable partitions between the chamber utilized for depositing the titanium layer and the chamber utilized for depositing zirconium layer. The titanium layer may be deposited immediately prior to the deposition of the zirconium metal layer. Generally, for rear erase exposure, a conductive layer light transparency of at least about 15 percent is desirable.

Regardless of the technique employed to form the zirconium and/or titanium layer, a thin layer of zirconium or titanium oxide forms on the outer surface of the metal upon exposure to air. Thus, when other layers overlying the zirconium layer are characterized as "contiguous" layers, it is intended that these overlying contiguous layers may, in fact, contact a thin zirconium or titanium oxide layer that has formed on the outer surface of the metal layer. If the zirconium and/or titanium layer is sufficiently thick to be self supporting, no additional underlying member is needed and the zirconium and/or titanium layer may function as both a substrate and a conductive ground plane layer. Ground planes comprising zirconium tend to continuously oxidize during xerographic cycling due to anodizing caused by the passage of electric currents, and the presence of this oxide layer tends to decrease the level of charge deficient spots with xerographic cycling. Generally, a zirconium layer thickness of at least about 100 angstroms is desirable to maintain optimum resistance to charge deficient spots during xerographic cycling. A typical electrical conductivity for conductive layers for electrophotographic imaging members in slow speed copiers is about $10^2$ to $10^3$ ohms/square.

After deposition of a metal layer, a hole blocking layer is applied thereto. Generally, electron blocking layers for positively charged photoreceptors allow holes from the imaging surface of the photoreceptor to migrate toward the conductive layer. Thus, an electron blocking layer is normally not expected to block holes in positively charged photoreceptors such as photoreceptors coated with charge generating layer and a hole transport layer. Any suitable hole blocking layer capable of forming an electronic barrier to holes between the adjacent photoconductive layer and the underlying zirconium and/or titanium layer may be utilized. The hole blocking layer is a nitrogen containing siloxanes such as trimethoxysilyl propylene diamine, hydrolyzed trimethoxysilyl propyl ethylene diamine, N-beta (aminoethyl) gamma-amino-propyl trimethoxy silane, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl dimethoxysilane. A preferred blocking layer comprises a reaction product between a hydrolyzed silane and a metal oxide layer which inherently forms on the surface of the metal layer when exposed to air after deposition. The imaging member is prepared by depositing on the metal oxide layer of a coating of an aqueous solution of the hydrolyzed silane at a pH between about 4 and about 10, drying the reaction product layer to form a siloxane film and applying electrically operative layers, such as a photogenerator layer and a hole transport layer, to the siloxane film.

The hydrolyzed silane may be prepared by hydrolyzing any suitable amino silane. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group.

After drying, the siloxane reaction product film formed from the hydrolyzed silane contains larger molecules. The reaction product of the hydrolyzed silane may be linear, partially crosslinked, a dimer, a trimer, and the like.

The hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product films may be achieved with solutions containing from about 0.1 percent by weight to about 5.0 percent by weight of the silane based on the total weight of the solution. A solution containing from about 0.05 percent by weight to about 0.2 percent by weight silane based on the total weight of solution are preferred for stable solutions which form uniform reaction product layers. It is important that the pH of the solution of hydrolyzed silane be carefully controlled to obtain optimum electrical stability. A solution pH between about 4 and about 10 is preferred. Optimum reaction product layers are achieved with hydrolyzed silane solutions having a pH between about 7 and about 8, because inhibition of cycling-up and cycling-down characteristics of the resulting treated photoreceptor are maximized. Some tolerable cycling-down has been observed with hydrolyzed amino silane solutions having a pH less than about 4.

Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorsilicic acid, Bromocresol Green, Bromophenol Blue, p-toluene sulfonic acid and the like.

Any suitable technique may be utilized to apply the hydrolyzed silane solution to the metal oxide layer of a metallic conductive anode layer. Typical application techniques include spraying, dip coating, roll coating, wire wound rod coating, and the like. Although it is preferred that the aqueous solution of hydrolyzed silane be prepared prior to application to the metal oxide layer, one may apply the silane directly to the metal oxide layer and hydrolyze the silane in situ by treating the deposited silane coating with water vapor to form a hydrolyzed silane solution on the surface of the metal oxide layer in the pH range described above. The water vapor may be in the form of steam or humid air. Generally, satisfactory results may be achieved when the reaction product of the hydrolyzed silane and metal oxide layer forms a layer having a thickness between about 20 Angstroms and about 2,000 Angstroms.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. The temperature selected depends to some extent on the specific metal oxide layer utilized and is limited by the temperature sensitivity of the substrate. The reaction temperature may be maintained by any suitable technique such as ovens, forced air ovens, radiant heat lamps, and the like.

The reaction time depends upon the reaction temperatures used. Thus less reaction time is required when higher reaction temperatures are employed. Satisfactory results have been achieved with reaction times between about 0.5 minute to about 45 minutes at elevated temperatures. For practical purposes, sufficient cross-linking is achieved by the time the reaction product layer is dry provided that the pH of the aqueous solution is maintained between about 4 and about 10.

One may readily determine whether sufficient condensation and cross-linking has occurred to form a siloxane reaction product film having stable electric chemical properties in a machine environment by merely washing the siloxane reaction product film with water, toluene, tetrahydrofuran, methylene chloride or cyclohexanone and examining the washed siloxane reaction product film to compare infrared absorption of Si—O—wavelength bands between about 1,000 to about 1,200 cm −1. If the Si—O—wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer. This siloxane coating is described in U.S. Pat. No. 4,464,450 to L. A. Teuscher, the disclosure of thereof being incorporated herein in its entirety.

The siloxane blocking layer should be continuous and have a thickness of less than about 0.5 micrometer because greater thicknesses may lead to undesirably high residual voltage. A blocking layer of between about 0.005 micrometer and about 0.3 micrometer (50 Angstroms–3000 Angstroms) is preferred because charge neutralization after the exposure step is facilitated and optimum electrical performance is achieved. A thickness of between about 0.03 micrometer and about 0.06 micrometer is preferred for zirconium and/or titanium oxide layers for optimum electrical behavior and reduced charge deficient spot occurrence and growth. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like.

Any suitable polyarylate film forming thermoplastic ring compound may be utilized as one key component of the uniform blend or polymers in the adhesive layer. Polyarylates are derived from aromatic dicarboxylic acids and diphenols and their preparation is well known. The preferred polyarylates are prepared from isophthalic or terephthalic acids and bisphenol A. In general, there are two processes that are widely used to prepare polyarylates. The first process involves reacting acid chlorides, such as isophthaloyl and terephthaloyl chlorides, with diphenols, such as bisphenol A, to yield polyarylates. The acid chlorides and diphenols can be treated with a stoichiometric amount of an acid acceptor, such as triethylamine or pyridine. Alternatively, an aqueous solution of the dialkali metal salt of the diphenols can be reacted with a solution of the acid chlorides in a water-insoluble solvent such as methylene chloride, or a solution of the diphenol and the acid chlorides can be contacted with solid calcium hydroxide with triethylamine serving as a phase transfer catalyst. The second process involves polymerization by a high-temperature melt or slurry process. For example, diphenyl isophthalate or terephthalate is reacted with bisphenol A in the presence of a transition metal catalyst at temperatures greater than 230° C. Since transesterification is a reversible process, phenol, which is a by-product, must be continually removed from the reaction vessel in order to continue polymerization and to produce high molecular weight polymers. Various processes for preparing polyarylates are disclosed in "Polyarylates," by Maresca and Robeson in Engineering Thermoplastics, James Margolis, ed., New York: Marcel Dekker, Inc. (1985), pages 255–259, which is incorporated herein by reference as well as the articles and patents disclosed therein which describe the various processes in greater detail.

A typical polyarylate has repeating units represented in the following formula:

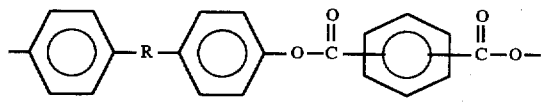

wherein R is $C_1$–$C_6$ alkylene, preferably $C_3$. These polyarylates are solvent soluble and have a weight average molecular weight greater than about 5,000 and preferably greater than about 30,000. The preferred polyarylate polymers have recurring units of the formula:

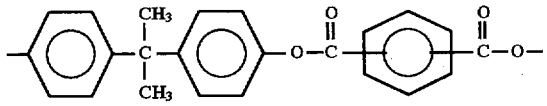

The phthalate moiety may be from isophthalic acid, terephthalic acid or a mixture of the two at any suitable ratios ranging from about 99 percent isophthalic acid and about I percent terephthalic acid to about 1 percent isophthalic acid and about 99 percent terephthalic acid, with a preferred mixture being between about 75 percent isophthalic acid and about 25 percent terephthalic acid and optimum results being achieved with between about 50 percent isophthalic acid and about 50 percent terephthalic acid. The polyarylates Ardel from Amoco and Durel from Celanese Chemical Company are preferred polymers. The most preferred polyarylate polymer is available from the Amoco Performance Products under the tradename Ardel D-100. Ardel is prepared from bisphenol-A and a mixture of 50 mol percent each of terephthalic and isophthalic acid chlorides by conventional methods. Ardel D-100 has a melt flow at 375° C. of 4.5 g/10 minutes, a density of 1.21 $Mg/m^3$, a refractive index of 1.61, a tensile strength at yield of 69 MPa, a thermal conductivity (k) of 0.18 W/m°K. and a volume resistivity of $3\times10^{16}$ ohm-cm. Durel is an amorphous homopolymer with a weight average molecular weight of about 20,000 to about 200,000. Different polyarylates may be blended in the compositions of the invention along with the polyester. These polyarylates are disclosed in U.S. Pat. No. 5,492,785, the entire disclosure thereof being incorporated herein by reference.

Any suitable copolyester film forming resin may be blended with the polyarylate film forming polymer to form the adhesive layer of this invention. The polyarylate and copolyester should be miscible to form a uniform blend. An especially preferred copolyester is a linear saturated copolyester reaction product of four diacids and ethylene glycol. The molecular structure of this linear saturated copolyester has the following structural formula:

$$\mathrm{HOC}\overset{\overset{\mathrm{O}}{\|}}{}\text{—[diacid—ethylene glycol]}_n\text{—OH}$$

where n is the degree of polymerization which is between about 170 and about 370. The mole ratio of diacid to ethylene glycol in the copolyester is 1:1. The diacids are terephthalic acid, isophthalic acid, adipic acid and azelaic acid. The mole ratio of terephthalic acid to isophthalic acid to adipic acid to azelaic acid is 4:4:1:1. A representative linear saturated copolyester of this structure is commercially available as Mor-Ester 49,000 (available from Morton International Inc., previously available from dupont de Nemours & Co.). The Mor-Ester 49,000 is a linear saturated copolyester which consists of alternating monomer units of ethylene glycol and four randomly sequenced diacids in the above indicated ratio and n in the structural formula has a value which gives a weight average molecular weight of about 70,000. This linear saturated copolyester has a Tg of about 32° C. Another preferred representative polyester resin is a copolyester resin having the above structural formula is one where the diacid is selected from the group consisting of terephthalic acid, isophthalic acid, and mixtures thereof; the diol is selected from the group consisting of ethylene glycol, 2,2-dimethyl propane diol and mixtures thereof; the ratio of diacid to diol is 1:1; n is a number between about 175 and about 350 and the Tg of the copolyester resin is between about 50° C. about 80° C. Typical polyester resins having the above structure are commercially available and include, for example, Vitel PE-100, Vitel PE-200, Vitel PE-200D, and Vitel PE-222, all available from Goodyear Tire and Rubber Co. More specifically, Vitel PE-100 polyester resin is a linear saturated copolyester of two diacids and ethylene glycol where the ratio of diacid to ethylene glycol in this copolyester is 1:1. The diacids are terephthalic acid and isophthalic acid. The ratio of terephthalic acid to isophthalic acid is 3:2. The Vitel PE-100 linear saturated copolyester consists of alternating monomer units of ethylene glycol and two randomly sequenced diacids in the above indicated ratio and has a weight average molecular weight of about 50,000 and a Tg of about 71° C. This copolyester is represented by the following formula:

$$\mathrm{HOC}\overset{\overset{\mathrm{O}}{\|}}{}\text{—[diacid—diol]}_n\text{—OH}$$

wherein the diacid is selected from the group consisting of terephthalic acid, isophthalic acid, and mixtures thereof, the diol comprises ethylene glycol and 2,2-dimethyl propane diol, the mole ratio of diacid to diol is 1:1, the mole ratio of terephthalic acid to isophthalic acid is 1.2:1, the mole ratio of ethylene glycol to 2,2-dimethyl propane diol is 1.33:1, n is a number between about 160 and about 330, and the Tg of said copolyester resin is between about 50° C. and about 80° C.

Another polyester resin, represented by the above formula, is Vitel PE-200 available from Goodyear Tire & Rubber Co. This polyester resin is a linear saturated copolyester of two diacids and two diols where the ratio of diacid to diol in the copolyester is 1:1. The diacids are terephthalic acid and isophthalic acid. The ratio of terephthalic acid to isophthalic acid is 1.2:1. The two diols are ethylene glycol and 2,2-dimethyl propane diol. The ratio of ethylene glycol to dimethyl propane diol is 1.33:1. The Goodyear PE-200 linear saturated copolyester consists of randomly alternating monomer units of the two diacids and the two diols in the above indicated ratio and has a weight average molecular weight of about 45,000 and a Tg of about 67° C.

The diacids from which the polyester resin component of this invention are derived are terephthalic acid, isophthalic acid, adipic acid and/or azelaic acid acids only. Any suitable diol may be used to synthesize the polyester resins employed in the adhesive layer of this invention. Typical diols include, for example, ethylene glycol, 2,2-dimethyl propane diol, butane diol, pentane diol, hexane diol, and the like. Copolyester resins are known and disclosed, for example, in U.S. Pat. No. 4,786,570 and U.S. Pat. No. 5,571,649, the entire disclosures of these two patents being incorporated herein by reference.

Satisfactory results are achieved when the uniform blend of film forming polymers in the adhesive layer of this invention comprises between about 20 parts by weight and about 90 parts by weight polyarylate and between 80 parts by weight and about 10 parts by weight polyester, based on the total weight of the dried adhesive layer. For optimum adhesion, the adhesive layer comprises between about 50 parts by weight and about 75 parts by weight polyarylate and between 50 parts by weight and about 25 parts by weight polyester, based on the total weight of the adhesive layer.

When the amount of polyarylate is less than about 20 weight percent, delamination is likely to occur during belt fabrication or image cycling. When amount of polyarylate in the blend is greater than about 90 weight percent, the dark decay of the resulting photoreceptor may become unacceptably high and the cycle down increases.

Any suitable solvent may be used to form an adhesive layer coating solution. Typical solvents include tetrahydrofuran, toluene, hexane, cyclohexane, cyclohexanone, methylene chloride, 1,1,2-trichloroethane, monochlorobenzene, chloroform, N-methylpyrrolidinone, N,N-dimethylformamide, N,N-dimethylacetamide, and the like, and mixtures thereof. Any suitable technique may be utilized to apply the adhesive layer coating. Typical coating techniques include extrusion coating, gravure coating, spray coating, wire wound bar coating, and the like. The adhesive layer comprising the polyarylate resin and polyester blend is applied directly to the charge blocking layer. Thus, the adhesive layer of this invention is in direct contiguous contact with both the underlying charge blocking layer and the overlying charge generating layer to enhance adhesion bonding and to effect ground plane hole injection suppression. Drying of the deposited coating may be effected by any suitable conventional process such as oven drying, infra red radiation drying, air drying and the like. The adhesive layer of this invention should be continuous. Satisfactory results are achieved when the adhesive layer has a thickness between about 0.03 micrometer and about 2 micrometers after drying. Preferably, the dried thickness is between about 0.05 micrometer and about I micrometer. At thickness of less than about 0.03 micrometer, the adhesion between the charge generating layer and the blocking layer is poor and delamination can occur when the photoreceptor belt is transported over small diameter supports such as rollers and curved skid plates. When the thickness of the adhesive layer of this invention is greater than about 2 micrometers, excessive residual charge buildup is observed during extended cycling.

Although much improved adhesion is obtained with 100% Polyarylate as the adhesive interface, there is an accompanying increase in the observed dark decay and cycle down of the photoreceptor. Therefore a mixture of the Polyarylate and the Polyester may be advantageous to control the level of dark decay and cycle down. The dramatically improved adhesion achieved with the adhesive layer of this invention enables slitting of a web without edge delamination, allows grinding at a welded seam to control seam thickness, and greatly extends electrophotographic image cycling life. Moreover, the adhesive layer also provides superior electrical and adhesive properties when it is employed in combination with a charge generating layer comprising hydroxygallium phthalocyanine particles dispersed in a film forming resin.

The charge generating layer of the photoreceptor of this invention comprises a photoconductive hydroxygallium phthalocyanine pigment. Hydroxygallium phthalocyanine particles are available in numerous polymorphic forms and are extensively described in the technical and patent literature. For example, hydroxygallium phthalocyanine Type V and other polymorphs are described in U.S. Pat. No. 5,521,306, the entire disclosure of this patent being incorporated herein by reference. Any suitable hydroxygallium phthalocyanine polymorph may be used in the charge generating layer of the photoreceptor of this invention. Generally, the hydroxygallium phthalocyanine particle size utilized is less than the thickness of the dried charge generating layer and the average particle size is less than about I micrometer. Optimum results are achieved with a pigment particle size between about 0.2 micrometer and about 0.3 micrometer. The hydroxygallium phthalocyanine particles are dispersed in any suitable film forming polymer binder. Preferred film forming polymer binders include copolymers of polystyrene/vinylpyridene, poly(4,4'-diphenyl-1,1'-cyclohexane carbonate), and the like. These polymers are known in the art and described, for example, in U.S. Pat. No. 5,384,223, U.S. Pat. No. 5,384,223, and U.S. Pat. No. 5,571,649, the entire disclosures of these three patents being incorporated herein by reference.

Poly(4,4'-diphenyl-1,1'-cyclohexane carbonate) has repeating units represented in the following formula:

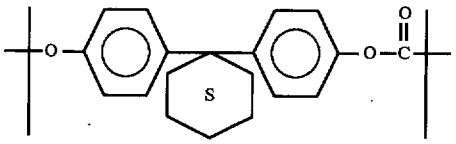

wherein "S" in the formula represents saturation. Preferably, this film forming polycarbonate binder has a molecular weight between about 20,000 and about 80,000.

Copolymers of polystyrene/vinylpyridene include, for example, AB block copolymers of polystyrene/poly-4-vinyl pyridine having a $M_w$ of from about 7,000 to about 80,000, and more preferably from about 10,500 to about 40,000 and wherein the percentage of vinyl pyridine is from about 5 to about 55 and preferably from about 9 to about 20. Block copolymers of polystyrene/poly-4-vinyl pyridine are known and described, fore example, in U.S. Pat. No. 5,384,222 and U.S. Pat. No. 5,384,223, the entire disclosures of these patents being incorporated herein by reference.

Satisfactory results may be achieved when the dried charge generating layer contains between about 20 percent and about 80 percent by volume dispersed hydroxygallium phthalocyanine particles, based on the total volume of the dried charge generating layer. Preferably, the hydroxygallium phthalocyanine particles are present in an amount between about 30 percent and about 50 percent by volume. Optimum results are achieved with an amount between about 35 percent and about 45 percent by volume.

Any suitable solvent may be utilized to dissolve the polycarbonate binder. Typical solvents include tetrahydrofuran, toluene, methylene chloride, and the like. Toluene is preferred because it has no discernible adverse effects on xerography and has an optimum boiling point to allow adequate drying of the generator layer during a typical slot coating process.

The dispersions for the charge generating layer may be formed by any suitable technique using, for example, attritors, ball mills, Dynomills, paintshakers, homogenizers, microfiuidizers, and the like.

Satisfactory results may be achieved with a dry charge generating layer thickness between about 0.1 micrometer and about 3 micrometers. Preferably, the charge generating layer has a dried thickness of between about 0.3 micrometers and about 1.0 micrometers. The photogenerating layer thickness is related to binder content. Thicknesses outside these ranges can be selected providing the objectives of the present invention are achieved. Typical charge generating layer thicknesses give an optical density from about 0.8 and about 1.2.

Any suitable coating technique may be used to apply coatings. Typical coating techniques include slot coating, gravure coating, roll coating, spray coating, spring wound bar coating, dip coating, drawbar coating, reverse roll coating, and the like.

Any suitable drying technique may be utilized to solidify and dry the deposited coatings. Typical drying techniques include oven drying, forced air drying, infrared radiation drying, and the like.

Any suitable charge transport layer may be utilized. The active charge transport layer may comprise any suitable transparent organic polymer of non-polymeric material capable of supporting the injection of photo-generated holes and electrons from the charge generating layer and allowing the transport of these holes or electrons through the organic layer to selectively discharge the surface charge. The charge transport layer in conjunction with the generation layer in the instant invention is a material which is an insulator to the extent that an electrostatic charge placed on the transport layer is not conducted in the absence of illumination Thus, the active charge transport layer is a substantially non-photoconductive material which supports the injection of photogenerated holes from the generation layer.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble. A dried charge transport layer containing between about 40 percent and about 50 percent by weight of the small molecule charge transport molecule based on the total weight of the dried charge transport layer is preferred.

The charge transport layer forming mixture preferably comprises an aromatic amine compound. Typical aromatic amine compounds include triphenyl amines, bis and poly triarylamines, bis arylamine ethers, bis alkyl-arylamines and the like.

Examples of charge transporting aromatic amines for charge transport layers capable of supporting the injection of photogenerated holes of a charge generating layer and transporting the holes through the charge transport layer include, for example, triphenylmethane, bis(4-diethylamine-2-methylphenyl)phenylmethane; 4'-4"-bis(diethylamino)-2', 2"-dimethyltriphenylmethane, N, N'-bis(alkylphenyl)-[1,1'-biphenyl]-4,4'-diamine wherein the alkyl is, for example, methyl, ethyl, propyl, n-butyl, etc., N,N'-diphenyl-N,N'-bis (chlorophenyl)-[1,1 '-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The preferred electrically inactive resin materials are polycarbonate resins have a molecular weight from about 20,000 to about 120,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used. A dried thickness of between about 18 micrometers and about 35 micrometers is preferred with optimum results being achieved with a thickness between about 24 micrometers and about 29 micrometers.

Preferably, the charge transport layer comprises an arylamine small molecule dissolved or molecularly dispersed in a polycarbonate.

Other layers such as conventional ground strips comprising, for example, conductive particles disposed in a film forming binder may be applied to one edge of the photoreceptor in contact with the zirconium and/or titanium layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

REVERSE PEEL TEST

The photoconductive imaging members were evaluated for adhesive properties using a 180° (reverse) peel test method.

The 180° peel strength is determined by cutting a minimum of five 0.5 inch×6 inches imaging member samples from each of Examples I through V. For each sample, the charge transport layer is partially stripped from the test imaging member sample with the aid of a razor blade and then hand peeled to about 3.5 inches from one end to expose part of the underlying charge generating layer. The test imaging member sample is secured with its charge transport layer surface toward a 1 inch×6 inches×0.5 inch aluminum backing plate with the aid of two sided adhesive tape, 1.3 cm (½ inch) width Scotch Magic Tape #810, available from 3M Company. At this condition, the anti-curl layer/substrate of the stripped segment of the test sample can easily be peeled away 180° from the sample to cause the adhesive layer to separate from the charge generating layer. The end of the resulting assembly opposite to the end from which the charge transport layer is not stripped is inserted into the upper jaw of an Instron Tensile Tester. The free end of the partially peeled anti-curl/substrate strip is inserted into the lower jaw of the Instron Tensile Tester. The jaws are then activated at a 1 inch/min crosshead speed, a 2 inch chart speed and a load range of 200 grams to 180° peel the sample at least 2 inches. The load monitored with a chart recorder is calculated to give the peel strength by dividing the average load required for stripping the anti-curl layer with the substrate by the width of the test sample.

ELECTRICAL SCANNING TEST

The electrical properties of the photoconductive imaging samples prepared according to Examples I through V were evaluated with a xerographic testing scanner comprising a cylindrical aluminum drum having a diameter of 24.26 cm (9.55 inches). The test samples were taped onto the drum. When rotated, the drum carrying the samples produced a constant surface speed of 76.3 cm (30 inches) per second. A direct current pin corotron, exposure light, erase light, and five electrometer probes were mounted around the periphery of the mounted photoreceptor samples. The sample charging time was 33 milliseconds. The expose light had a 670 nm output and erase light was broad band white light (400–700 nm) output, each supplied by a 300 watt output Xenon arc lamp. The test samples were first rested in the dark for at least 60 minutes to ensure achievement of equilibrium with the testing conditions at 40 percent relative humidity and 21° C. Each sample was then negatively charged in the dark to a development potential of about 900 volts. The charge acceptance of each sample and its residual potential after discharge by front erase exposure to 400 ergs/cm$^2$ were recorded. Dark Decay was measured as a loss of Vddp after 0.66 seconds. The test procedure was repeated to determine the photo induced discharge characteristic (PIDC) of each sample by different light energies of up to 20 ergs/cm$^2$. The photodischarge is given as the ergs/cm$^2$ needed to discharge the photoreceptor from a Vddp of 800 volts or 600 volts to 100 volts, QV intercept is an indicator of depletion charging. The test is repeated for 10,000 cycles and the Vddp is remeasured to determine cycle down.

EXAMPLE I

A control photoconductive imaging member was prepared by providing a web of titanium coated polyester (Melinex, available from ICI Americas Inc.) substrate having a thickness of 3 mils, and applying thereto, with a gravure applicator, a solution containing 50 grams 3-aminopropyltriethoxysilane, 41.2 grams water, 15 grams acetic acid, 684.8 grams of 200 proof denatured alcohol and 200 grams heptane. This layer was then dried for about 5 minutes at 135° C. in the forced air drier of the coater. The resulting blocking layer had a dry thickness of 500 Angstroms.

An adhesive interface layer was then prepared by applying a wet coating over the blocking layer, using a gravure applicator, containing 3.5 percent by weight based on the total weight of the solution of copolyester adhesive (49,000, available from Morton International, Specialty Chemicals Group) in a 70:30 volume ratio mixture of tetrahydrofuran/cyclohexanone. The adhesive interface layer was then dried for about 5 minutes at 135° C. in the forced air dryer of the coater. The resulting adhesive interface layer had a dry thickness of 620 Angstroms A photogenerating layer containing 40 percent by volume of hydroxygallium phthalocyanine Type V, and 60 percent by volume of copolymer polystyrene (90 percent)/poly-4-vinyl pyridine (10 percent) with Mw of 15,000. This photogenerating layer was prepared by introducing 1.5 gram of polystyrene/poly-4-vinyl pyridine and 50 milliliters of toluene into a 4 ounce amber bottle. To this solution was added 1.33 gram. of Type V hydroxygallium phthalocyanine and 300 grams of 1/8 inch diameter stainless steel shot. This mixture was then placed on a ball mill for 24 hours. The resulting slurry was, thereafter, applied to the adhesive interface with a Bird applicator to form a layer having a wet thickness of 0.25 mil. The layer was dried at 135° C. for 5 minutes in a forced air oven to form a dry thickness photogenerating layer having a thickness of 0.4 micrometer.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Farbenfabriken Bayer A.G. The resulting mixture was dissolved in methylene chloride to form a solution containing 15 percent by weight solids. This solution was applied on the photogenerator layer using a Bird applicator to form a coating which upon drying had a thickness of 25 microns. During this coating process the humidity was equal to or less than 15 percent. The resulting photoreceptor device containing all of the above layers was annealed at 135° C. in a forced air oven for 5 minutes and thereafter cooled to ambient room temperature.

EXAMPLE II

A photoreceptor was prepared as in Example I except that instead of 100 percent of the copolyester, the adhesive layer was prepared to contain 75 weight percent of the copolyester and 25 weight percent polyarylate ARDEL D-100 (Amoco Performance Products)in tetrahydrofuran. The adhesive interface layer was then dried for about 5 minutes at 135° C. in the forced air dryer of the coater. The resulting adhesive interface layer had a dry thickness of 590 Angstroms.

EXAMPLE III

A photoreceptor was prepared as in Example II except that the adhesive layer was prepared to contain 50 weight percent of the copolyester and 50 weight percent polyarylate ARDEL D-100 (Amoco Performance Products). in tetrahydrofuran. The resulting adhesive interface layer had a dry thickness of 600 Angstroms.

EXAMPLE IV

A photoreceptor was prepared as in Example II except that the adhesive layer was prepared to contain 25 weight percent of the copolyester and 75 weight percent polyarylate ARDEL D-100 (Amoco Performance Products). in tetrahydrofuran. The resulting adhesive interface layer had a dry thickness of 600 Angstroms.

EXAMPLE V

A photoreceptor was prepared as in Example II except that the adhesive layer was prepared to contain 0 weight percent of the copolyester and 100 weight percent polyarylate ARDEL D-100 (Amoco Performance Products). in tetrahydrofuran. The resulting adhesive interface layer had a dry thickness of 600 Angstroms.

EXAMPLE VI

Examples I through V were tested for adhesive and electrical properties. Table A below gives the results of the reverse peel test and the electrical scanning test which were previously described.

TABLE A

| | Ratio copolyester/ polyarylate | Adhesion Reverse Peel g/cm | PIDC ergs/cm$^2$ | Dark Decay volts | % Loss of Vddp |
|---|---|---|---|---|---|
| Example I | 100/0 | 2.4 | 4.0 | −141 | 14.6 |
| Example II | 75/25 | 3.5 | 4.4 | −136 | 15.0 |
| Example III | 50/50 | 16.8 | 4.5 | −162 | 18.8 |
| Example IV | 25/75 | 43.6 | 4.5 | −193 | 20..4 |
| Example V | 0/100 | 65 | 4.6 | −216 | 23.1 |

These results show that adhesion increases with an increasing amount of polyarylate in the adhesive layer. Dark Decay and cycle down can be controlled by the amount of copolyester in the adhesive layer with lesser amounts giving lower dark decay.

While the embodiment disclosed herein is preferred, it will be appreciated from this teaching that various alternative, modifications, variations or improvements therein may be made by those having ordinary skill in the art, which are intended to be encompassed by the following claims:

What is claimed is:

1. An electrophotographic imaging member having an imaging surface adapted to accept a negative electrical charge, said electrophotographic imaging member comprising a substrate, a siloxane hole blocking layer, an adhesive layer comprising a uniform blend of polyarylate film forming resin and polyester film forming resin, a charge generation layer comprising hydroxygallium phthalocyanine particles dispersed in a film forming resin, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

2. An electrophotographic imaging member according to claim 1 wherein said polyarylate film forming resin has the following repeating structural units:

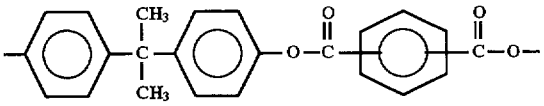

3. An electrophotographic imaging member according to claim 2 wherein said polyarylate film forming resin is solvent soluble and has a weight average molecular weight of at least about 5,000.

4. An electrophotographic imaging member according to claim 3 wherein said polyarylate film forming resin has a weight average molecular weight of between about 20,000 and about 200,000.

5. An electrophotographic imaging member according to claim 1 wherein said polyester film forming resin is a copolyester having the following repeating structural formula:

$$\overset{O}{\overset{\|}{HOC}}-[\text{diacid}-\text{ethylene glycol}]_n-OH$$

wherein said diacid is selected from the group consisting of terephthalic acid, isophthalic acid, adipic acid and azelaic acid, the mole ratio of said terephthalic acid to said isophthalic acid to said adipic acid to said azelaic acid is 4:4:1:1, and n is the degree of polymerization which is between about 170 and about 370.

6. An electrophotographic imaging member according to claim 1 wherein said polyester film forming resin is a copolyester having the following repeating structural formula:

$$\overset{O}{\overset{\|}{HOC}}-[\text{diacid}-\text{diol}]_n-OH$$

wherein said diacid is selected from the group consisting of terephthalic acid, isophthalic acid, and mixtures thereof, said diol comprises ethylene glycol, 2,2-dimethyl, the ratio of said diacid to said diol is 1:1, the mole ratio of said terephthalic acid to said isophthalic acid is 1.2:1, the mole ratio of said ethylene glycol to said 2,2-dimethyl propane diol is 1.33:1, n is a number between about 160 and about 330, and said copolyester resin has a Tg of between about 50° C. and about 80° C.

7. An electrophotographic imaging member according to claim 1 wherein said adhesive layer comprises a uniform blend of between about 20 parts by weight and about 90 parts by weight of said polyarylate and between 80 parts by weight and about 10 parts by weight of said polyester, based on the total weight of said adhesive layer.

8. An electrophotographic imaging member according to claim 1 wherein said substrate comprises a metal ground plane layer comprising at least 50 percent by weight zirconium.

9. An electrophotographic imaging member according to claim 1 wherein said metal ground plane layer comprises a zirconium layer overlying a titanium layer.

10. An electrophotographic imaging member according to claim 9 wherein said zirconium layer has a thickness of at least about 60 Angstrom units.

11. An electrophotographic imaging member according to claim 1 wherein said blocking layer comprises an aminosiloxane.

12. An electrophotographic imaging member according to claim 1 wherein said a film forming resin is poly(4,4'-diphenyl-1,1'-cyclohexane carbonate).

13. An electrophotographic imaging member according to claim 1 wherein said a film forming resin is polystyrene/poly-4-vinyl pyridine copolymer.

14. An electrophotographic imaging member according to claim 1 wherein said charge generation layer comprises between about 20 percent and about 80 percent by volume of said hydroxygallium phthalocyanine particles, based on the total volume of said charge generating layer.

15. An electrophotographic imaging member according to claim 1 wherein said adhesive layer has a thickness between about 0.03 micrometer and about 2 micrometers after drying.

* * * * *